US011279448B2

(12) United States Patent
Goupil

(10) Patent No.: US 11,279,448 B2
(45) Date of Patent: Mar. 22, 2022

(54) WATERCRAFT BOARDING MECHANISM AND METHOD OF USE THEREOF

(71) Applicant: 9365-1461 QUEBEC INC., Sherbrooke (CA)

(72) Inventor: Francois Goupil, Sherbrooke (CA)

(73) Assignee: 9365-1461 QUEBEC INC., Sherbrooke (CA)

( * ) Notice: Subject to any disclaimer, the term of this patent is extended or adjusted under 35 U.S.C. 154(b) by 88 days.

(21) Appl. No.: 16/888,926

(22) Filed: Jun. 1, 2020

(65) Prior Publication Data

US 2020/0385091 A1 Dec. 10, 2020

Related U.S. Application Data

(60) Provisional application No. 62/857,336, filed on Jun. 5, 2019.

(51) Int. Cl.
*B63B 23/30* (2006.01)
*B63B 27/00* (2006.01)

(52) U.S. Cl.
CPC ..... *B63B 27/19* (2020.05)

(58) Field of Classification Search
CPC ..... B63B 27/19; B63B 23/30; B63B 23/32
See application file for complete search history.

(56) References Cited

U.S. PATENT DOCUMENTS 3,143,991 A 8/1964 Anderson
3,942,655 A * 3/1976 Andersen ..... B63B 27/19 43/8
4,864,951 A * 9/1989 Koepp, Jr. ..... B63B 23/32 114/44
5,193,479 A * 3/1993 Bielefeld ..... B63B 23/32 114/259
6,782,842 B1 8/2004 Alvord
7,478,608 B2 1/2009 Wesley
2006/0118026 A1* 6/2006 Zander ..... B63B 23/48 114/258

OTHER PUBLICATIONS https://seawisemarine.com—See Wise Davit System 2001.
https://www.freedomlift.com—2018.
www.hurleymarine.com—2017.

* cited by examiner

*Primary Examiner* — Stephen P Avila
(74) *Attorney, Agent, or Firm* — Benoit & Cote Inc.; Mathieu Audet

(57) ABSTRACT

A watercraft boarding apparatus is herein presented, the watercraft boarding apparatus including a frame adapted to be secured to an object, a pivotable platform pivotably secured to the frame about a pivot axis thereof, the pivotable platform being configured to pivot between an extended configuration for securing a watercraft on water and a boarded configuration supporting the watercraft thereon and a pair of connecting members secured to the pivotable platform to secure the watercraft, wherein pivotal of the platform is adapted to progressively board the watercraft on the platform by sharing a weight of the watercraft between the pivot and water. A method of use and a kit thereof are also contemplated and remain within the scope of the present specification.

17 Claims, 21 Drawing Sheets

WATERCRAFT BOARDING MECHANISM AND METHOD OF USE THEREOF

CROSS-REFERENCE TO RELATED APPLICATIONS

This United States Patent application is claiming priority from and is a non-provisional application of provisional application No. 62/857,336, filed Jun. 5, 2019, entitled WATERCRAFT BOARDING MECHANISM AND METHOD OF USE THEREOF. This document is enclosed herein by reference in its entirety.

FIELD OF THE INVENTION

The present invention generally relates to the field of watercraft boarding mechanism. Specifically, the present invention relates to a watercraft boarding mechanism that is using a pivotable motion to mount a watercraft or another boat or a fixed structure.

BACKGROUND OF THE INVENTION

Vessels are sometimes carrying a smaller watercraft called a dinghy. The dinghy can be pulled behind the vessel with a rope or can be lifted and supported by the vessel. Pulling behind another boat is increasing drag and can be detrimental to the handling of the pulling vessel in front. Otherwise, craning the dinghy on the vessel would require a mechanism strong enough to completely lift the entire weight of the dinghy. These lifting mechanisms are expensive, robust, heavy to carry and require complex maneuvers sometimes requiring more than one person to bring the dinghy on board and secure it properly.

Watercrafts are generally secured to a dock so that they are not carried away by the wind and the waves when the watercraft is no utilized to navigate on water. Securing a watercraft to a dock might be reasonable option in some circumstances but can challenge the integrity of the watercraft when there is strong weather with significant wind and waves.

Another system using ramps are available to pull a watercraft out of water with a sliding motion of the watercraft climbing the ramp to rest on an adjacent structure or simply to rest and stay on the ramps until it is put back on water.

However, these means of carrying or securing a watercraft to another vessel, or on a fixed structure, can be complicated and is requiring expensive equipment. These manipulations might also require many people to achieve and take significant time to achieve.

Therefore, it would be desirable to have a watercraft boarding apparatus that is capable of lifting a watercraft thereon, such as a dinghy, in a simple fashion.

It is desirable to provide a watercraft boarding apparatus that is using reduced power to raise a dinghy using adapted platform geometry and linkage.

Additionally, it would be desirable to provide a watercraft boarding apparatus that is light and economical that can be retrofitted on existing equipment.

OBJECTS OF THE INVENTION

An object of the present invention, in accordance with at least one embodiment thereof, is providing a watercraft boarding apparatus that does not require to suspend and support the complete weight of the watercraft. The boarding apparatus can be used to momentarily support and support a watercraft thereon, or serve as a watercraft parking. For simplification of the present application, the term "watercraft" is going to be used throughout the text although it is intended to encompass a personal watercraft, a boat, a floating toy that could be pulled by a vessel or used on water and be desirably pull out of the water for storage or for transportation.

One other object of the present invention, in accordance with at least one embodiment thereof, provides a watercraft boarding apparatus that is using a pivotal motion to progressively transfer the weight of the watercraft to another vessel/boat or a fixed structure like a dock or a building.

One object of the present invention, in accordance with at least one embodiment thereof, provides a watercraft boarding apparatus that can be retrofitted to an existing vessel/boat.

One object of the present invention, in accordance with at least one embodiment thereof, provides a watercraft boarding apparatus that can be retrofitted to a dock or a fixed structure.

One object of the present invention, in accordance with at least one embodiment thereof, provides a watercraft boarding apparatus that can be embedded in on OEM Boat design.

One object of the present invention, in accordance with at least one embodiment thereof, provides a watercraft boarding apparatus that is including a reversible platform that is usable on both opposed sides.

One other object of the present invention, in accordance with at least one embodiment thereof, provides a watercraft boarding apparatus that is requiring a single actuator to board the watercraft on a boat or a fixed structure.

One other object of the present invention, in accordance with at least one embodiment thereof, provides a watercraft boarding apparatus that can be manually operated.

Another object of the present invention provides, in accordance with at least one embodiment, a platform that is usable as an in-water platform to support a user at water lever to access the watercraft on water, usable as an out-of-water platform for people to use as a convenient space for sunbathing, for example, when no watercraft is supported by the platform, or be used as a watercraft-supporting apparatus when a watercraft is boarded on the platform.

Other and further objects and advantages of the present invention will be obvious upon an understanding of the illustrative embodiments about to be described or will be indicated in the appended claims, and various advantages not referred to herein will occur to one skilled in the art upon employment of the invention in practice.

SUMMARY OF THE INVENTION

The present invention includes many aspects and features. The aforesaid and other objectives of the present invention are realized by generally providing a new watercraft boarding apparatus and method of use thereof.

One aspect of the invention provides in accordance with at least one embodiment thereof, a watercraft boarding apparatus that can be added and secured to a stern of a boat.

One aspect of the invention provides, in accordance with at least one embodiment thereof, a watercraft boarding apparatus that can be added and secured to a transom of a boat.

One aspect of the invention provides, in accordance with at least one embodiment thereof, a watercraft boarding apparatus that can be added and secured to a rear swim platform of a boat.

One other aspect of the invention provides, in accordance with at least one embodiment thereof, a watercraft boarding apparatus that is including a pivot mechanism and adapted members linkage to progressively take a watercraft on the water and completely support the watercraft thereon.

One other aspect of the invention provides, in accordance with at least one embodiment thereof, a watercraft boarding apparatus that is including two opposed platforms or a single platform usable on two sides thereof.

One other aspect of the invention provides, in accordance with at least one embodiment thereof, a watercraft boarding apparatus that is using at least two connection points on the watercraft to board the watercraft on the boarding apparatus.

One other aspect of the invention provides, in accordance with at least one embodiment thereof, a watercraft boarding apparatus that is including aluminum or other material suitable to cope with oxidation without significant damages causes by the water.

One aspect of the invention provides, in accordance with at least one embodiment thereof, a watercraft boarding apparatus that is adjustable to match watercraft of various dimensions.

One aspect of the invention provides, in accordance with at least one embodiment thereof, a watercraft boarding that can be electrically actuated, manually actuated or hydraulically actuated.

One aspect of the invention provides, in accordance with at least one embodiment thereof, a watercraft boarding apparatus that can pivot of about 180-degree with a single motion.

The features of the present invention which are believed to be novel are set forth with particularity in the appended claims.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other objects, features and advantages of the invention will become more readily apparent from the following description, reference being made to the accompanying drawings in which.

DETAILED DESCRIPTION

Figure 1:
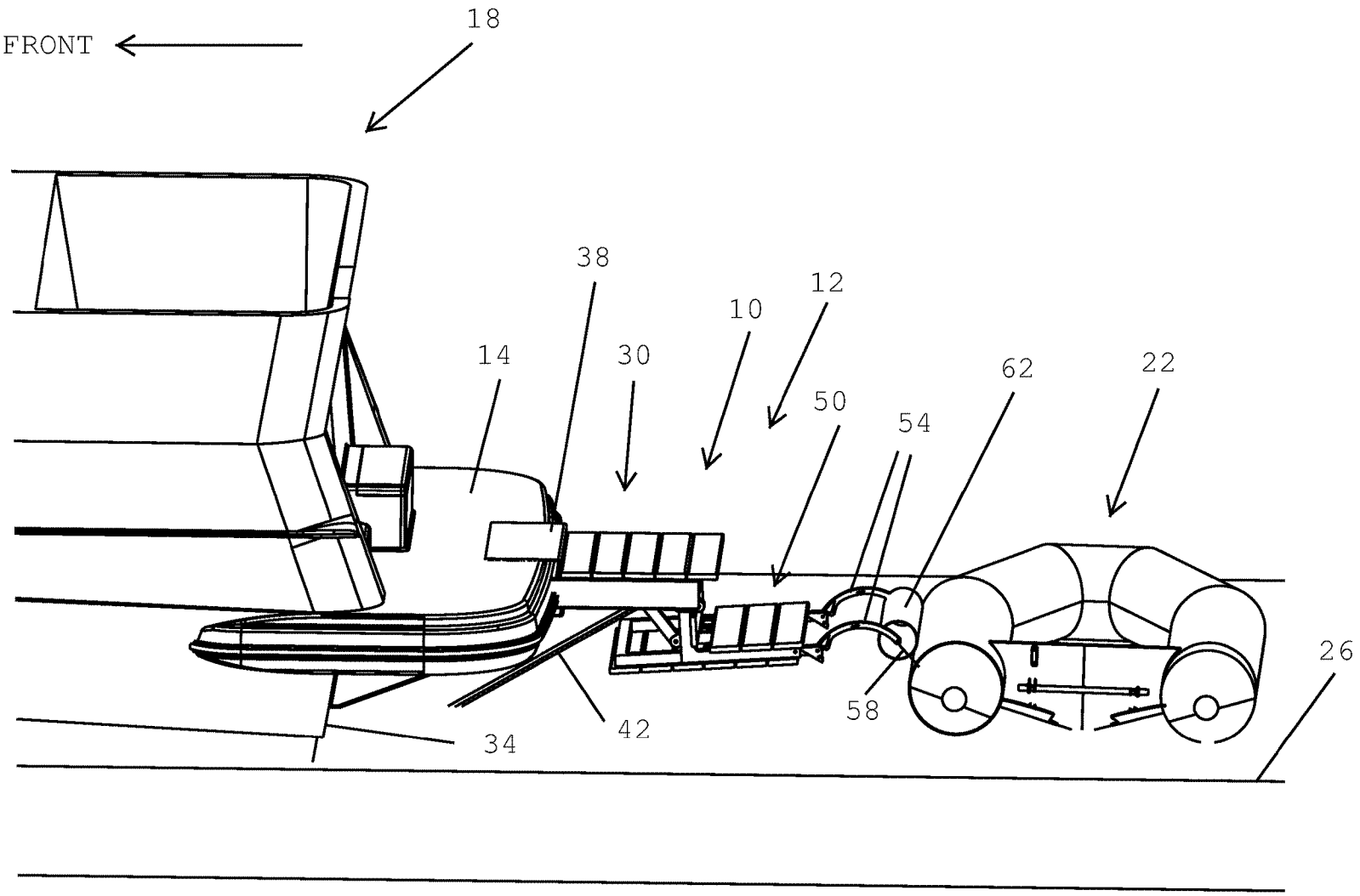
FIG. 1 is a left elevational side view of a watercraft boarding apparatus connected to a boat floating on water in accordance with principles and embodiments of the present invention.

As a preliminary matter, it will be understood by one having ordinary skill in the relevant art ("Ordinary Artisan") that the invention has broad utility and application. Furthermore, any embodiment discussed and identified as being "preferred" is Considered to be part of a best mode contemplated for carrying out the invention. Other embodiments also may be discussed for additional illustrative purposes in providing a full and enabling disclosure of the invention. Furthermore, an embodiment of the invention may incorporate only one or a plurality of the aspects of the invention discloses herein; only one or a plurality of the features disclosed herein; or combination thereof. As such, many embodiments are implicitly disclosing herein and fall within the scope of what is regarded as the invention.

Accordingly, while the invention is described herein in detail in relation to one or more embodiments, it is to be understood that this disclosure is illustrative and exemplary of the invention and is made merely for purposes of providing a full and enabling disclosure of the invention. The detailed disclosure herein of one or more embodiments is not intended, nor is to be construed, to limit the scope of patent protection afforded the invention in any claim of a patent issuing here from, which scope is to be defined by the claims and the equivalents thereof. II is not intended that the scope of patent protection afforded the invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the invention. Accordingly, it is intended that the scope of patent protection afforded the invention is to be defined by the issued claim(s) rather than the description set forth herein.

Additionally, it is important to note that each term used herein to that which the Ordinary Artisan would understand such term to mean bases on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory Provision is intended to and should apply in the interpretation of such claim element. with regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers." "a picnic basket having crackers without cheese", and "a picnic basket having both cheese and crackers." When used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese.".

Referring the drawings, one or more preferred embodiments of the invention are next described. The following description of one or more preferred embodiments is merely exemplary in nature and is in no way intended to limit the invention, its Implementations, or uses. Hence, a novel resistance apparatus will be described herein after.

A watercraft boarding apparatus 10, hereinafter referred to as WBA 10, in accordance with principles and embodiments thereof, is illustrated in FIG. 1. The WBA 10 is depicted in an extended configuration 12, secured to a rear platform 14 of a boat 18, and configured to board a watercraft 22 floating on water 26 on the boat 18. The WBA 10, in the illustrated configuration, includes a fixed platform 30 connected to a transom 34 of the boat 18 with a platform connector 38 and a pair of securing members 42. It can be appreciated the WBA 10 is including a pivotable platform 50 with a pair of connecting arms 54 adapted to connect the watercraft 22 to be handled by WBA 10. Conversely, the WBA 10 is illustrated in a watercraft boarded configuration 58, in FIG. 2, where the watercraft 22 is supported on the pivoted pivotable platform 50 at a distance from water 26. The connecting arms 54 are embodied as being pivotable to bring closer the watercraft 22 when the WBA 10 is actuated to pull the watercraft 22 out of water. This is allowing the WBA 10 to pivot over a predetermined angle about water level without having to support the weight of the watercraft 22 that is fully supported by water 26. The pivotable movement of the connecting arms 54 are also useful to provide some movement to attach the watercraft 22 thereon. The curved shape of the connecting arms 54 are also desirable in embodiments thereof to match a shape of the watercraft 22 hull when boarded although straight members could be alternatively be used. The connecting arms 54 can be used to secure and park the watercraft 22 on water, providing a stable connection for a user to climb on the watercraft 22, and for boarding the watercraft 22 on the WBA 10. A pair of ropes, not illustrated, could be alternatively be used although the ropes' flexibility is not going to allow strong hold of the watercraft 22, especially in a lateral direction, when the watercraft 22 is secured to the ropes. It can be appreciated an additional extension, embodied with connecting arms 54, are desirable for the functioning of the described invention.

Figure 2:
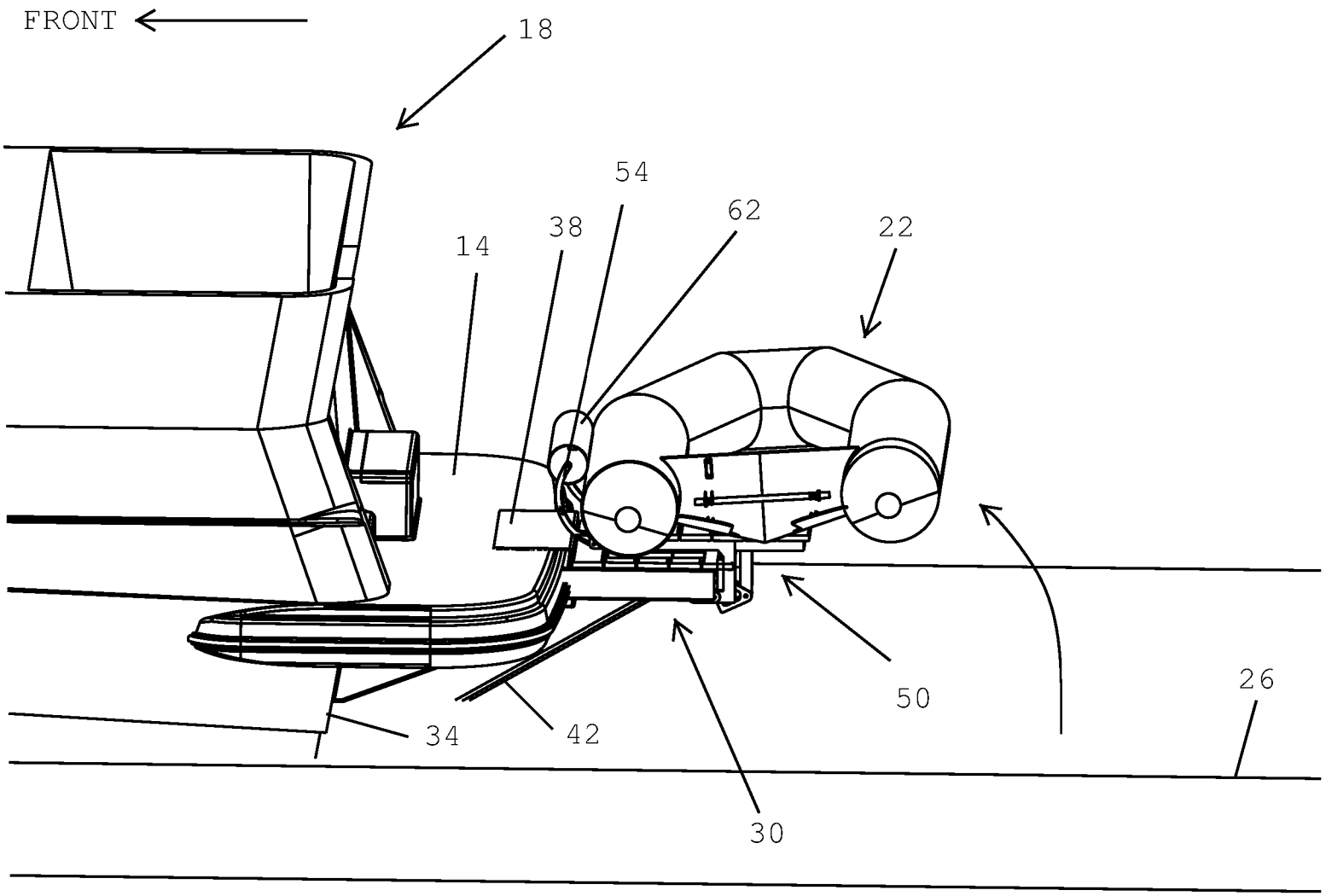
FIG. 2 is a left elevational side view of watercraft boarding apparatus connected to a boat supported by a vessel in accordance with principles and embodiments of the present invention.
Figure 3:
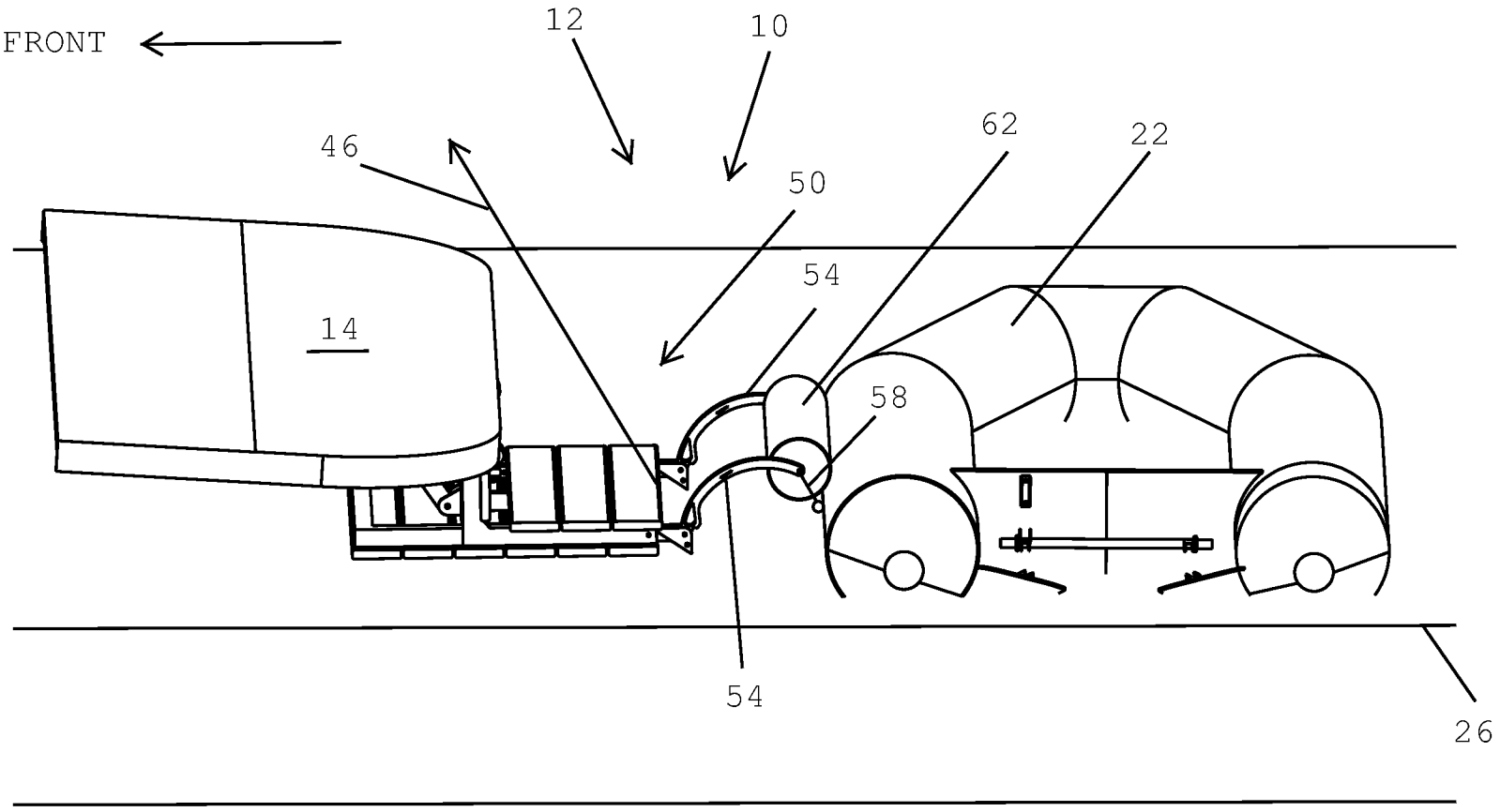
FIG. 3 is a left elevational side view of a watercraft boarding apparatus connected to a boat with an illustrated force vector applied to the watercraft boarding apparatus in accordance with principles and embodiments of the present invention.

A direct securing configuration 58 of the WBA 10 is illustrated in FIG. 3 where the WBA 10 is connected to the rear platform 14 of the boat 18 without the optional fixed platform 30 that is illustrated in FIG. 1 and FIG. 2 but not illustrated in FIG. 3. It can be appreciated the connecting arms 54 are secured to the watercraft 22 with a securing mechanism 58 selectively securing the connecting arms 54 with the watercraft 22 for boarding the watercraft 22. An optional intervening bumper 62 is located and secured in a position preventing direct contact between the pair of connecting arms and the watercraft 22.

Figure 4:
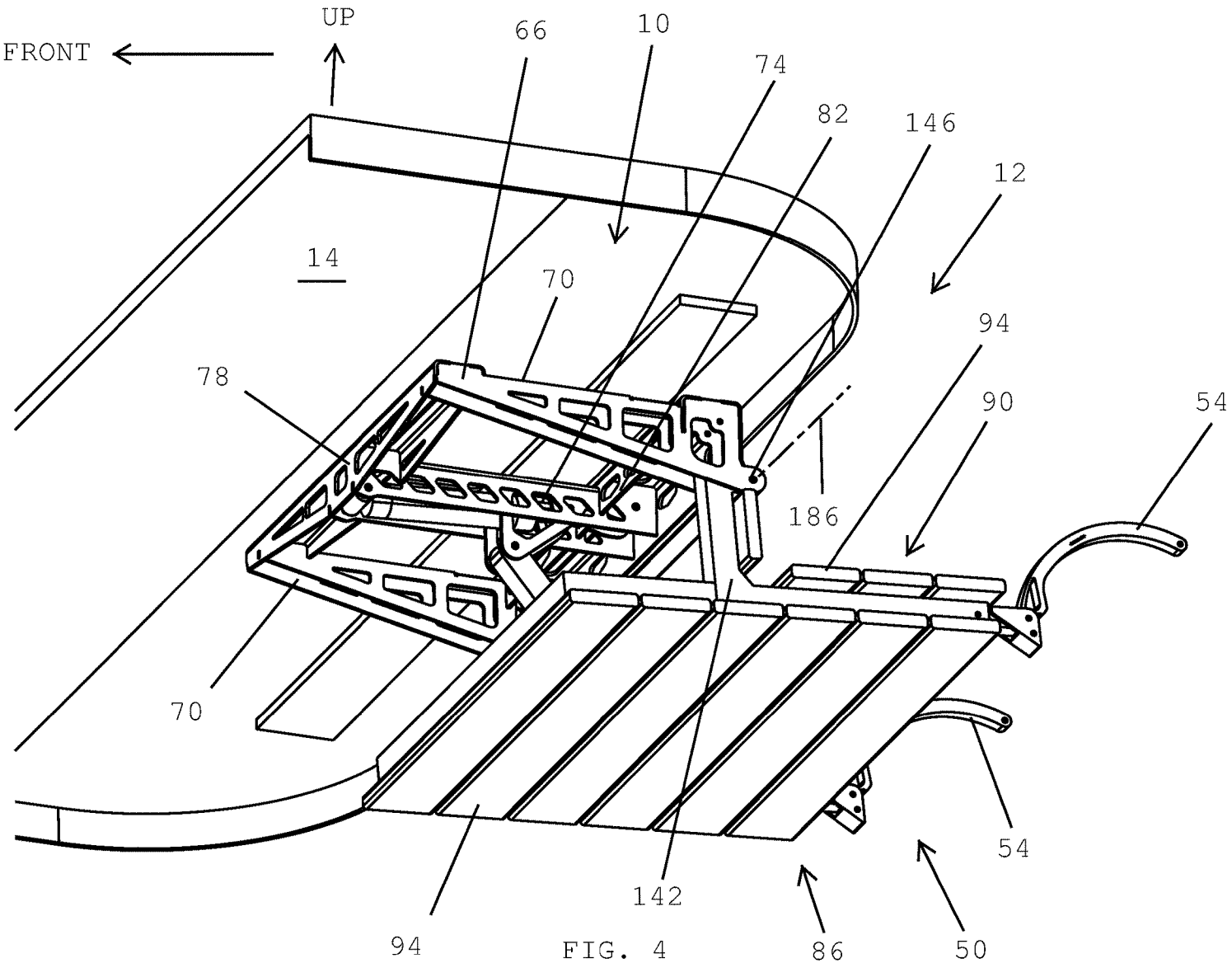
FIG. 4 is a bottom-left perspective side view of a watercraft boarding apparatus connected to a boat in accordance with principles and embodiments of the present invention.

The WBA 10 in the configuration connected to the rear platform 14 of the boat 18 without the optional fixed platform 30 (illustrated in FIG. 1) is shown in FIG. 4. The embodied WBA 10, illustrated in the extended configuration 12, includes a frame 66 with a pair of lateral supports 70, a central support 74, a first transversal support 78 and a second transversal support 82. The pivotable platform 50 includes a watercraft-supporting side 86 and a watercraft access side 90, both covered with a series of planks 94 or the like for either supporting the watercraft 22 or passengers thereon depending if a watercraft 22 is boarded or not.

Figure 5:
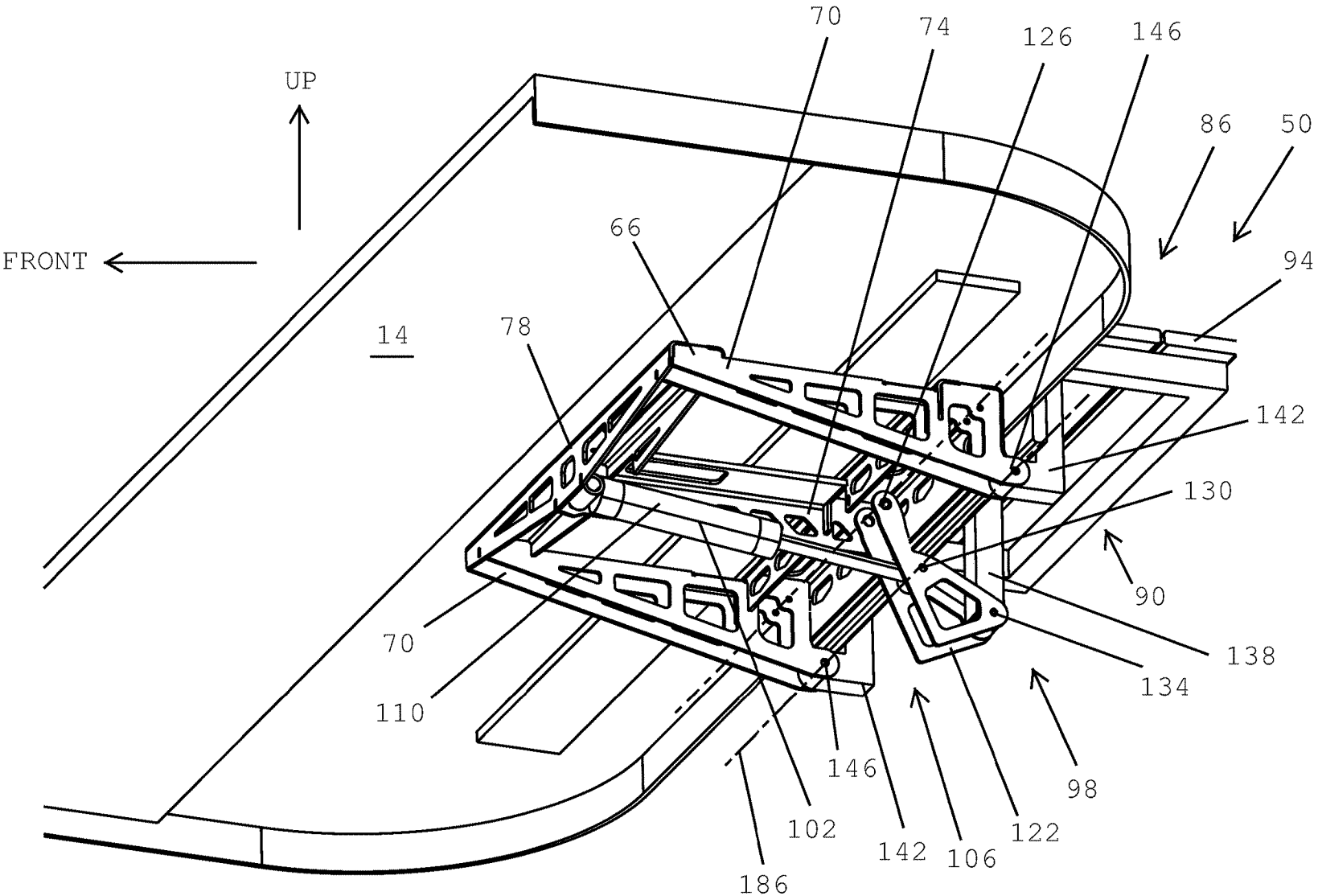
FIG. 5 is a bottom-left perspective side view of a watercraft boarding apparatus connected to a boat in accordance with principles and embodiments of the present invention.

FIG. 5 is depicting the WBA 10 of FIG. 4 in the boarded configuration 98. The boarded configuration 98 is realized with an extension of an actuator 102 secured to the frame 66. One can appreciate some elements of the WBA 10 have been disconnected or omitted to increase visibility and understanding of the WBA 10 structure. The actuator 102, as embodied in FIG. 4, is retracted to place the WBA 10 in the extended configuration 12 for securing the watercraft 22 floating on water and is extended 106 to place the WBA 10 in the boarded configuration 98, as illustrated in FIG. 5. The actuator 102 can be embodied as a hydraulic cylinder 110 and alternatively as an electric actuator 102 (not illustrated) or even be removed since the WBA 10 can also be manually actuated by hands, with or without a rope 45 arranged to be pulled from the rear platform 14 or from the boat as depicted in FIG. 3. The actuator 102 illustrated in FIG. 5 is secured, on a proximal side 114 thereof, to the first transversal support 78 of the frame 66 and secured, on a distal side 118 thereof, to a pivotable arm 122. The pivotable arm 122 includes a pivot portion 126 pivoting in respect with the frame 66, an actuator pivot 130 and a pivotable platform 50. II can be appreciated the actuator pivot 130 is not directly aligned with the pivot 126 to Allow the pivotal motion to occur without being self-locked when WBA 10 is in the extended configuration 12 by applying a force directly in line with the pivot portion 126. This means that, geometrically, the pivotal movement of the pivotable platform 50 is preferably limited to at most a little less than 180-degree for the pivotable platform 50 assembly to move correctly. The pivotable platform 50 is including a plurality of extending members 142 adapted to pivot about the lateral supports 70 via members pivots 146.

Figure 6:
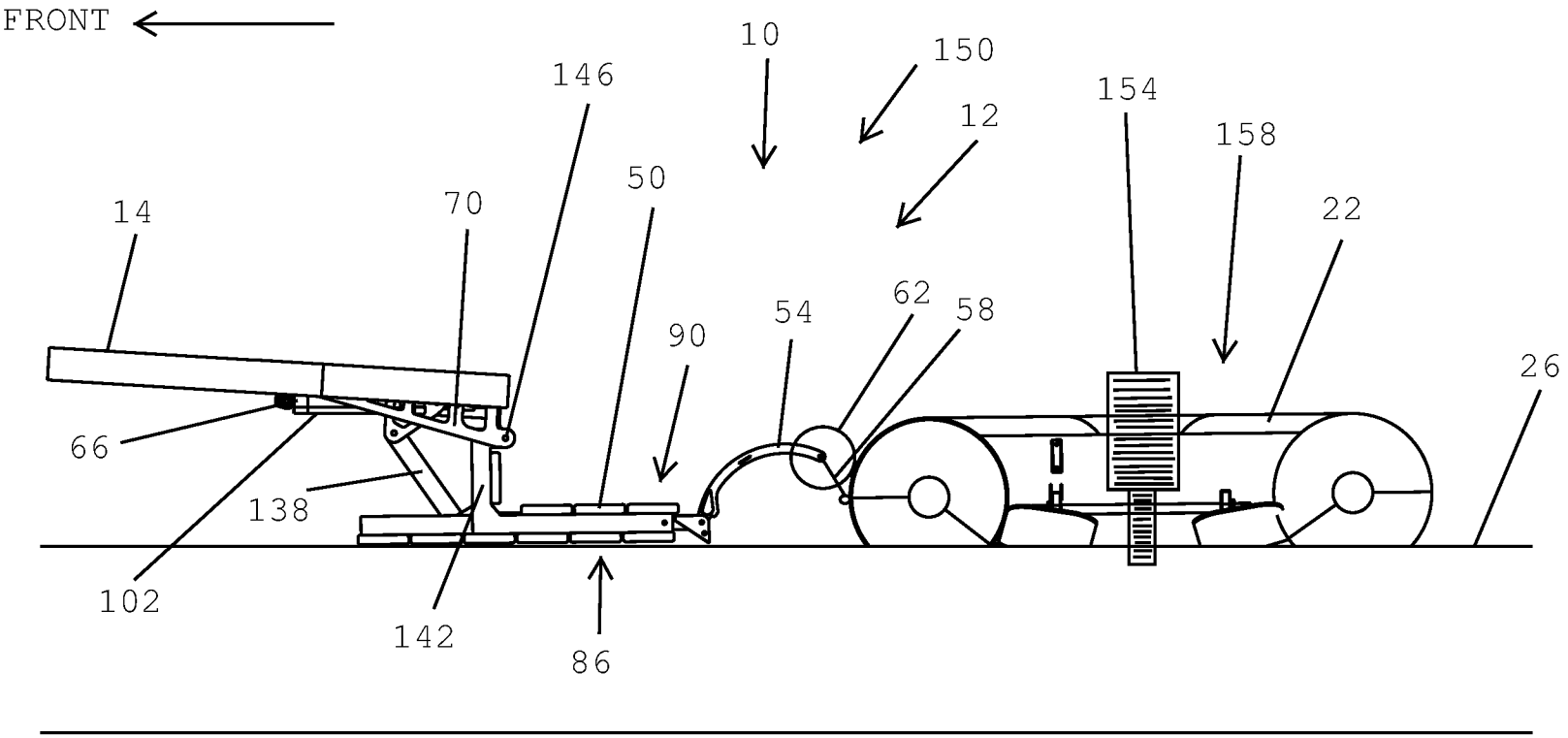
FIG. 6 is a left elevational side view of a watercraft boarding apparatus connected to a boat floating on water in accordance with principles and embodiments of the present invention.
Figure 12:
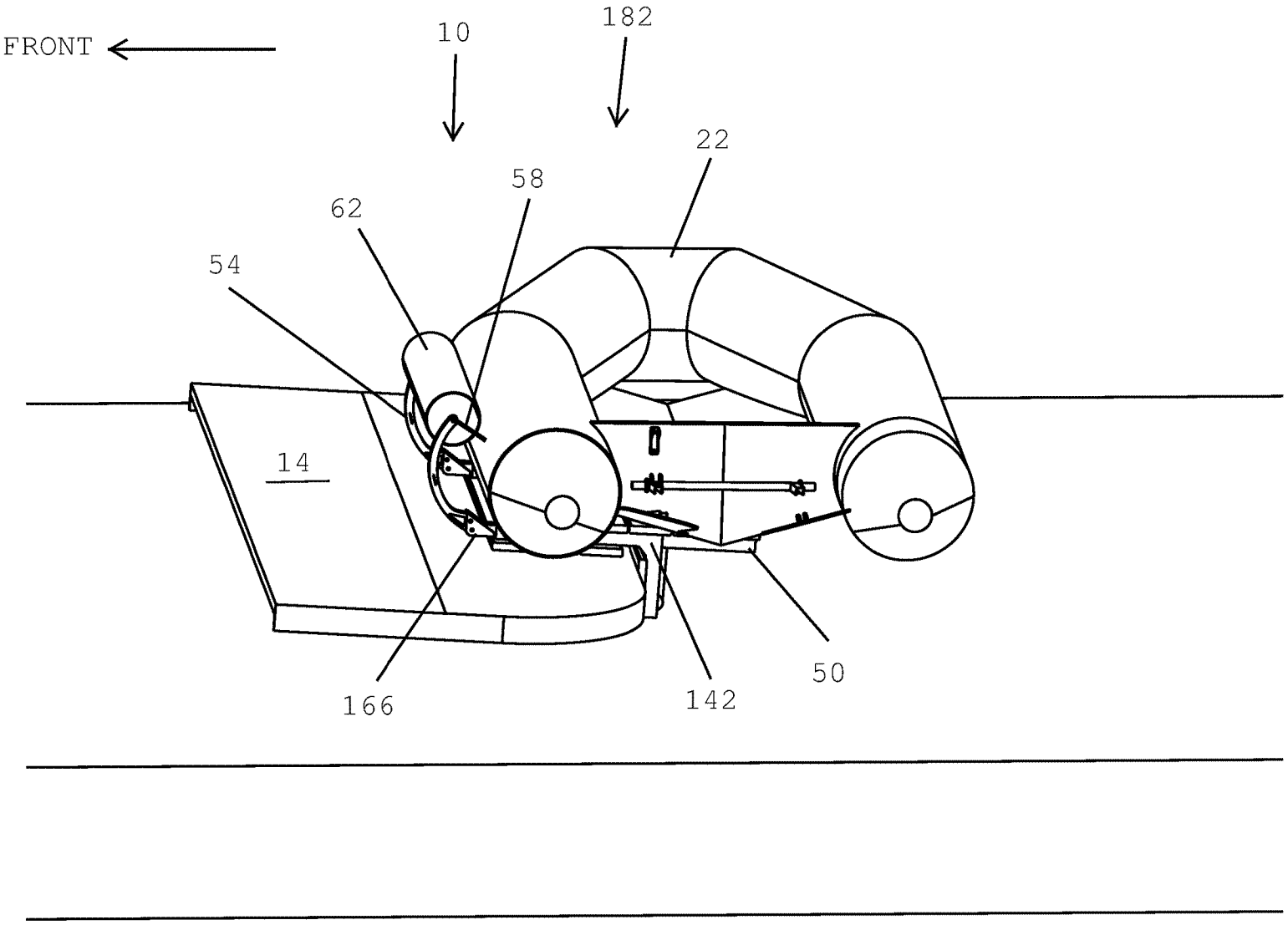
FIG. 12 is a left elevational side view of a watercraft boarding apparatus connected to a boat in a final onboard configuration in accordance with principles and embodiments of the present invention.

FIG. 6 throughout FIG. 12 are illustrating different functioning stages of the WBA 10 when boarding a watercraft 22. To begin with, FIG. 6 is representing a first stage 150 with the pivotable platform 50 in the extended configuration 12. The WBA 10 is secured directly under the rear platform 14 of the boat 18 (not illustrated in FIG. 6 throughout FIG. 12 to lighten the images). It can be appreciated the pivotable platform 50 is preferably leveled about the water level 26 to facilitate boarding of the watercraft 22. The position of the pivotable platform 50 is maintained with the actuator 102 in the retracted configuration to allow a person to step on the watercraft access side 90 of the pivotable platform 50 to go secure the securing mechanisms 58 to the watercraft 22. It can be appreciated both sides of the platform 50 can be used to step, rest, get access to water and other uses without departing from the scope of the invention. The securing mechanisms 58 can be embodied as hooks, clamps (not visible in details in these figures) or analogous mechanisms without departing from the scope of the present invention. One can note that the watercraft 22 can remains sufficiently leveled during the boarding process because the additional weight of the outboard engine 154 and the fuel tank 158 are mitigated by geometry of the WBA 10. Indeed, the WBA 10 geometry is progressively sharing the weight of the watercraft 22 and its components between the water 26 and the member pivots 146 as opposed to being sustained entirely by the actuator 102. Sharing the weight of the watercraft 22 is hence reducing the required force and strength of the WBA 10, or at least some components like the actuator 102.

Figure 7:
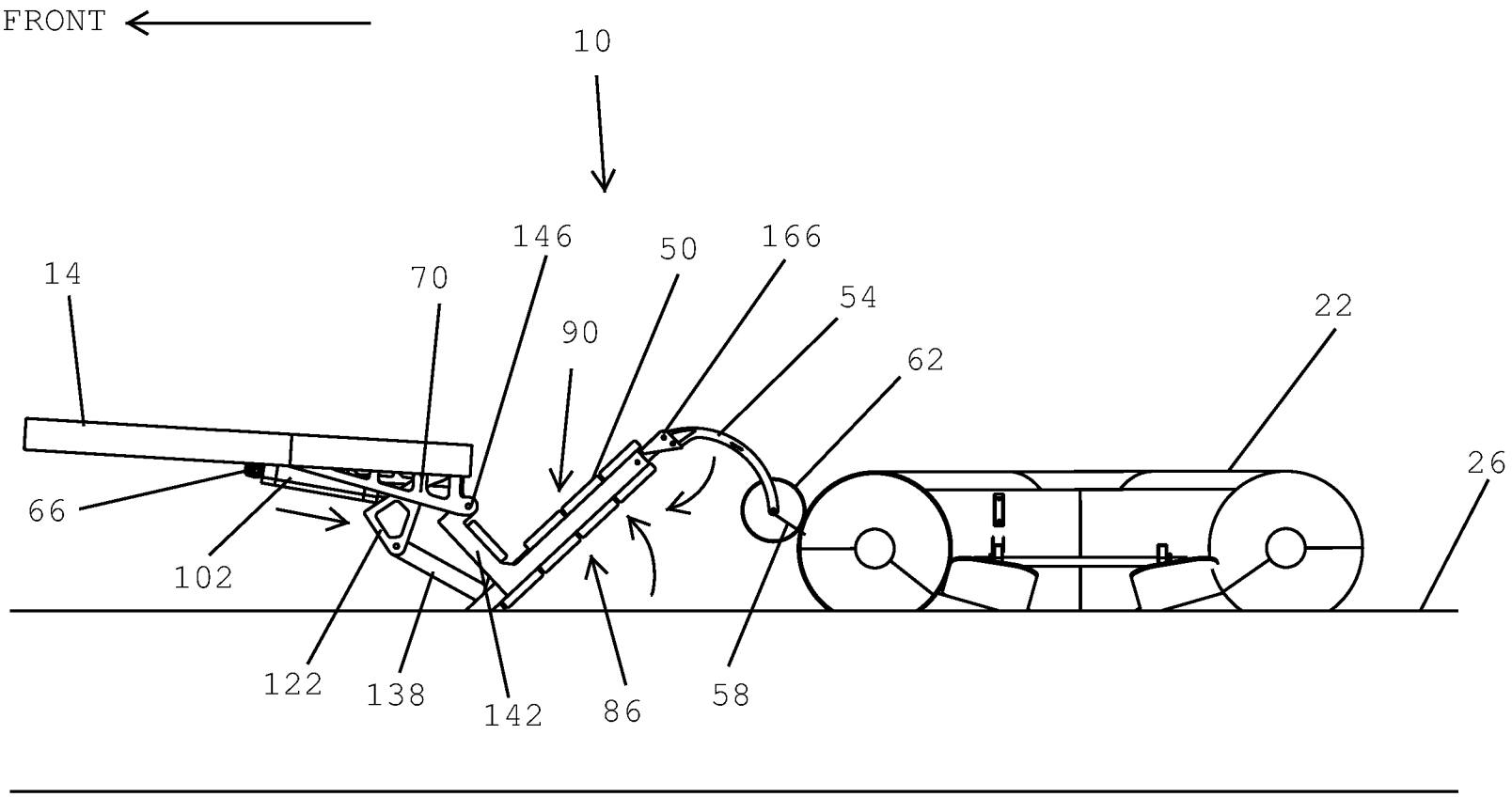
FIG. 7 is a left elevational side view of a watercraft boarding apparatus connected to a boat in an early stage of being raised onboard a vessel in accordance with principles and embodiments of the present invention.

A second stage 162 illustrating the pivotable platform 50 pivoting under the action of the actuator 102 is represented in FIG. 7. The actuation by the actuator 102 of the pivotable platform 50 above the water 26 is bringing the watercraft 22 closer to the watercraft-supporting side 86 of the pivotable platform 50. The complete weight of the watercraft 22 is supported by the water at this stage. The connecting arms 52 are also pivoting progressively about their respective pivot 166 to maintain the watercraft's 22 weight on the water 26 when the WBA 10 is actuated.

Figure 8:
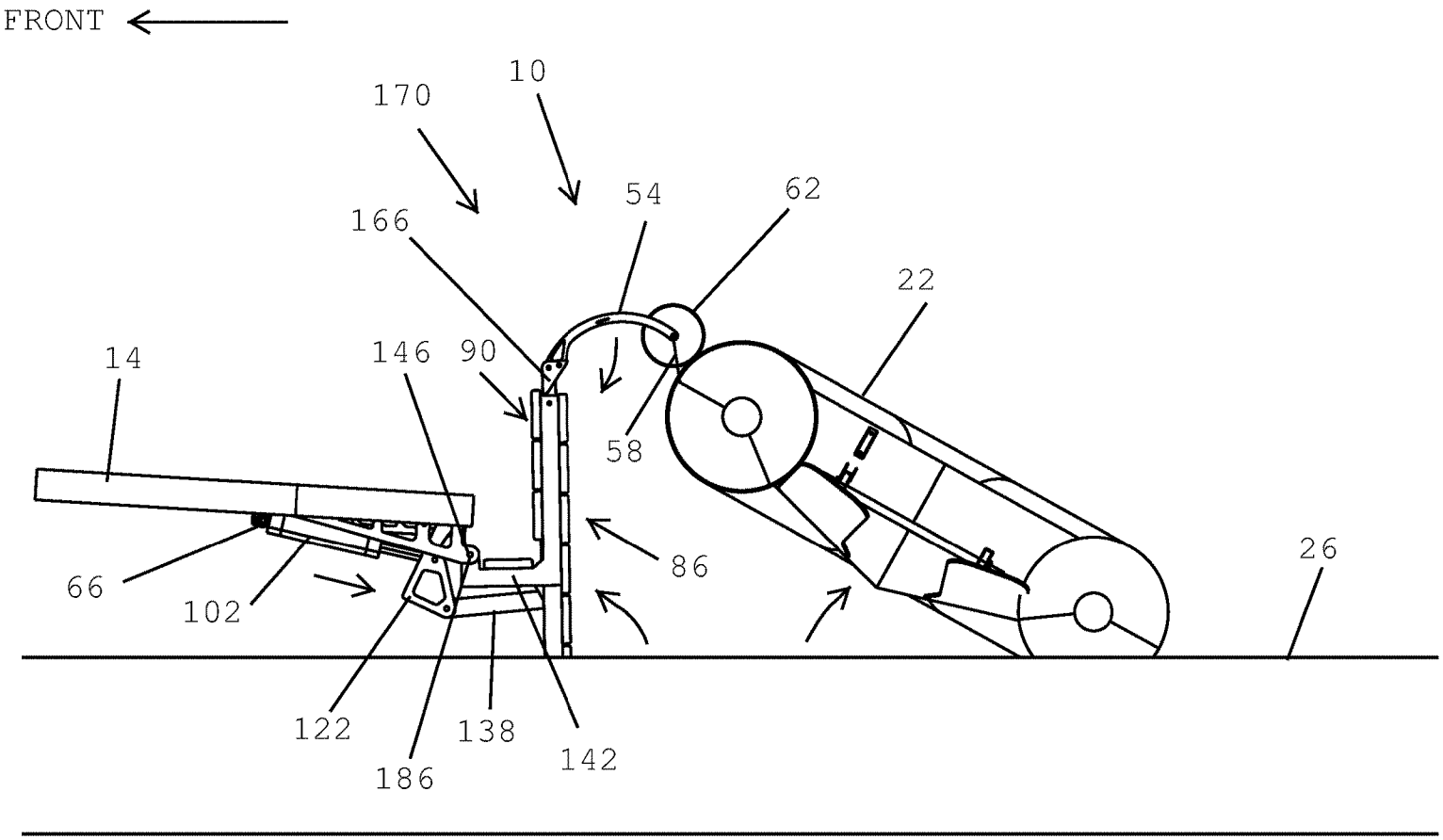
FIG. 8 is a left elevational side view of a watercraft boarding apparatus. Connected to a boat in a stage of being raised onboard a vessel in accordance with principles and embodiments of the present invention.

FIG. 8 is illustrating a third stage 170 with the watercraft 22 beginning to raise above water 26 on a side proximal to the WBA 10 while the opposite side of the watercraft 22 is remaining supported by the water 26. Put differently, about half of the weight of the watercraft 22 is supported by the water 26 at this stage while the remaining weight is share by the member pivots 146 and blocked by the actuator 102. The actuator 102 is thus supporting only a fraction of the weight of the watercraft 22 with this advantageous mechanical system.

Figure 9:
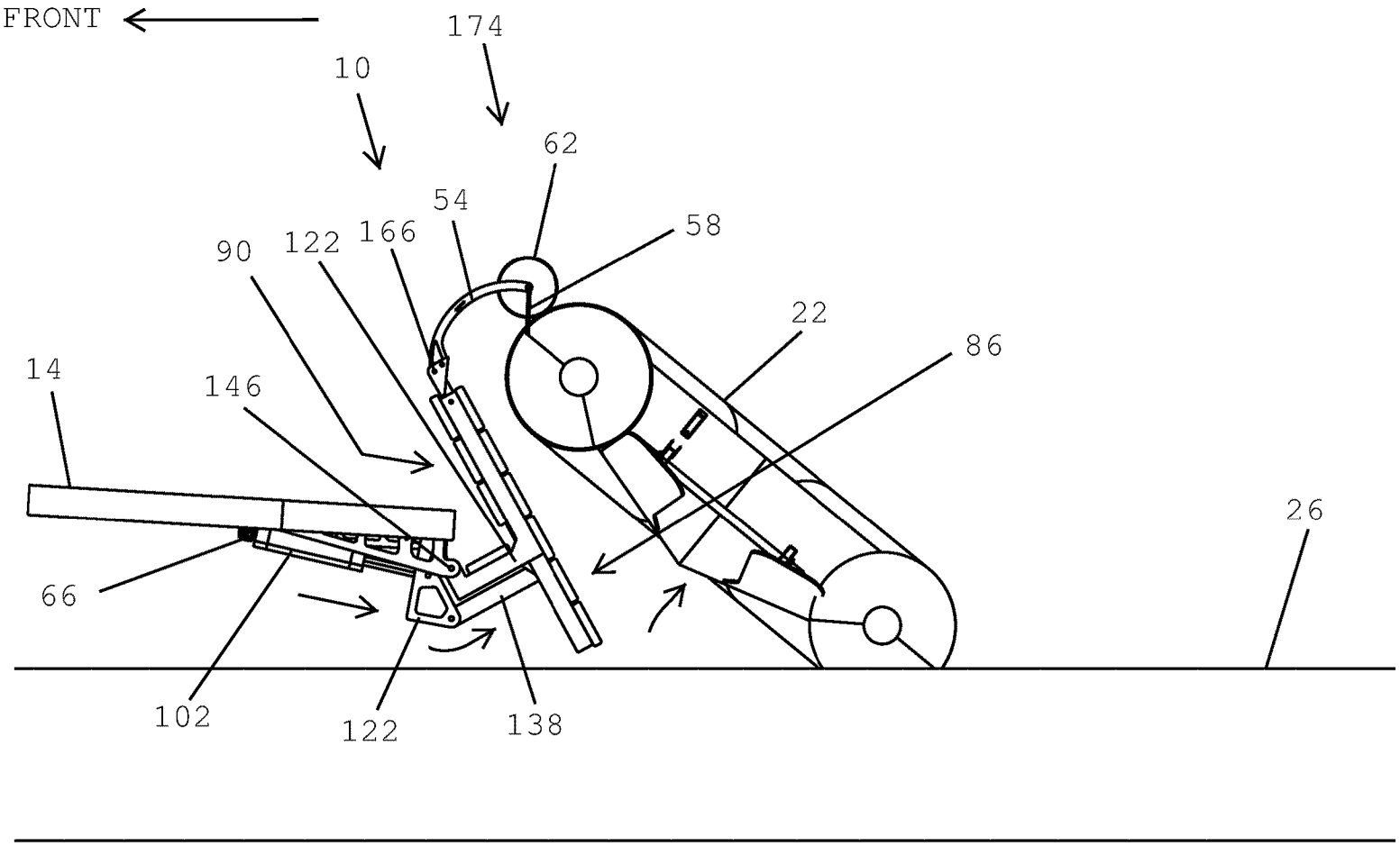
FIG. 9 is a left elevational side view of a watercraft boarding apparatus connected to a boat in a stage of being raised onboard a vessel in accordance with principles and embodiments of the present invention.

FIG. 9 is illustration a fourth stage 174 with the watercraft 22 continuing to raise above water 26 on the side proximal to the WBA 10 while the opposite side of the watercraft 22 remains supported by the water 26. Similarly, about half of the weight of the watercraft 22 is supported by the water 26 at this stage while the remaining watercraft's 22 weight is shared by the member pivots 146 and the actuator 102, among other components. The actuator 102 is thus supporting only a fraction of the weight of the watercraft 22.

Figure 10:
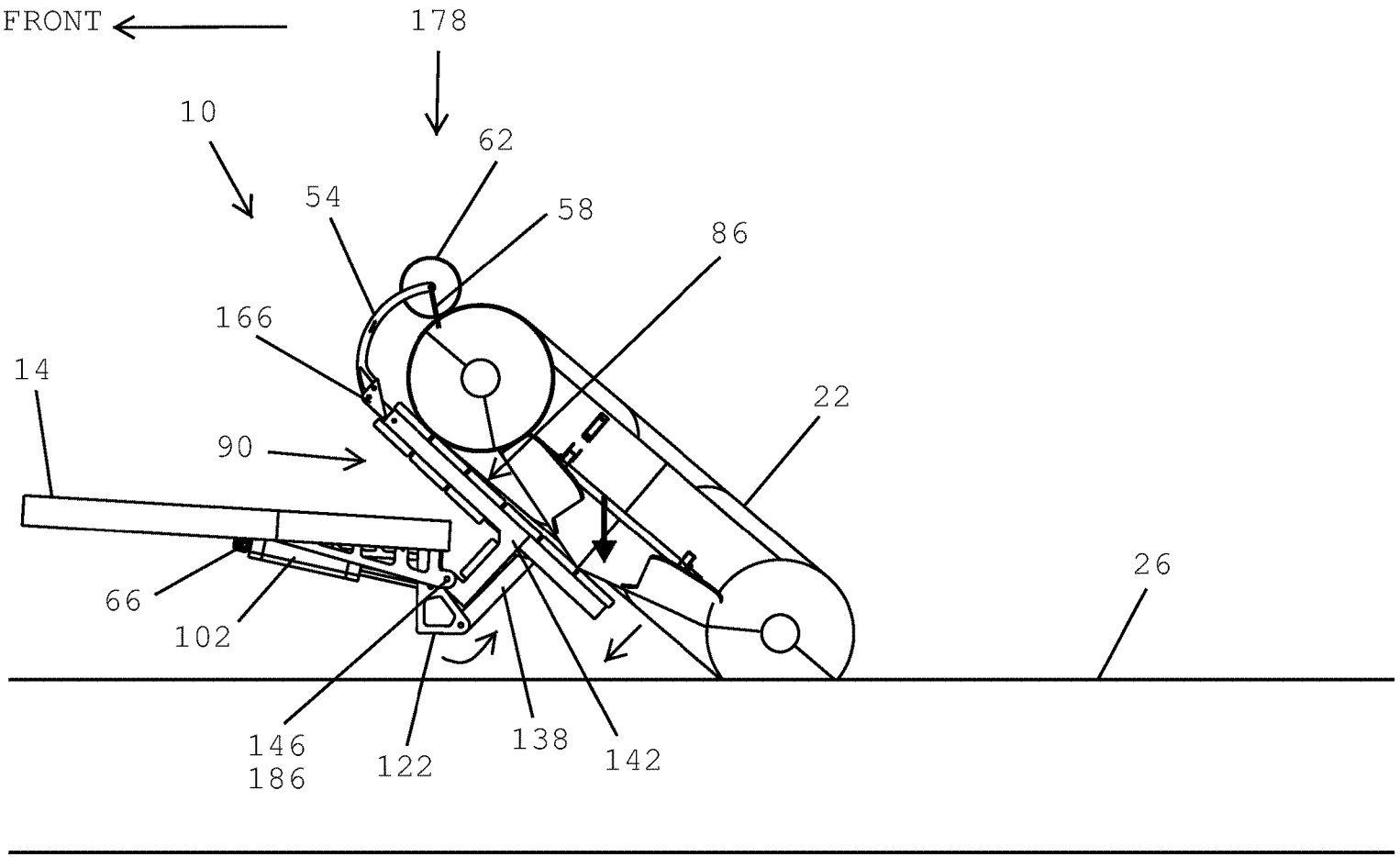
FIG. 10 is a left elevational side view of a watercraft boarding apparatus connected to a boat in a stage of being raised onboard a vessel in accordance with principles and embodiments of the present invention.
Figure 11:
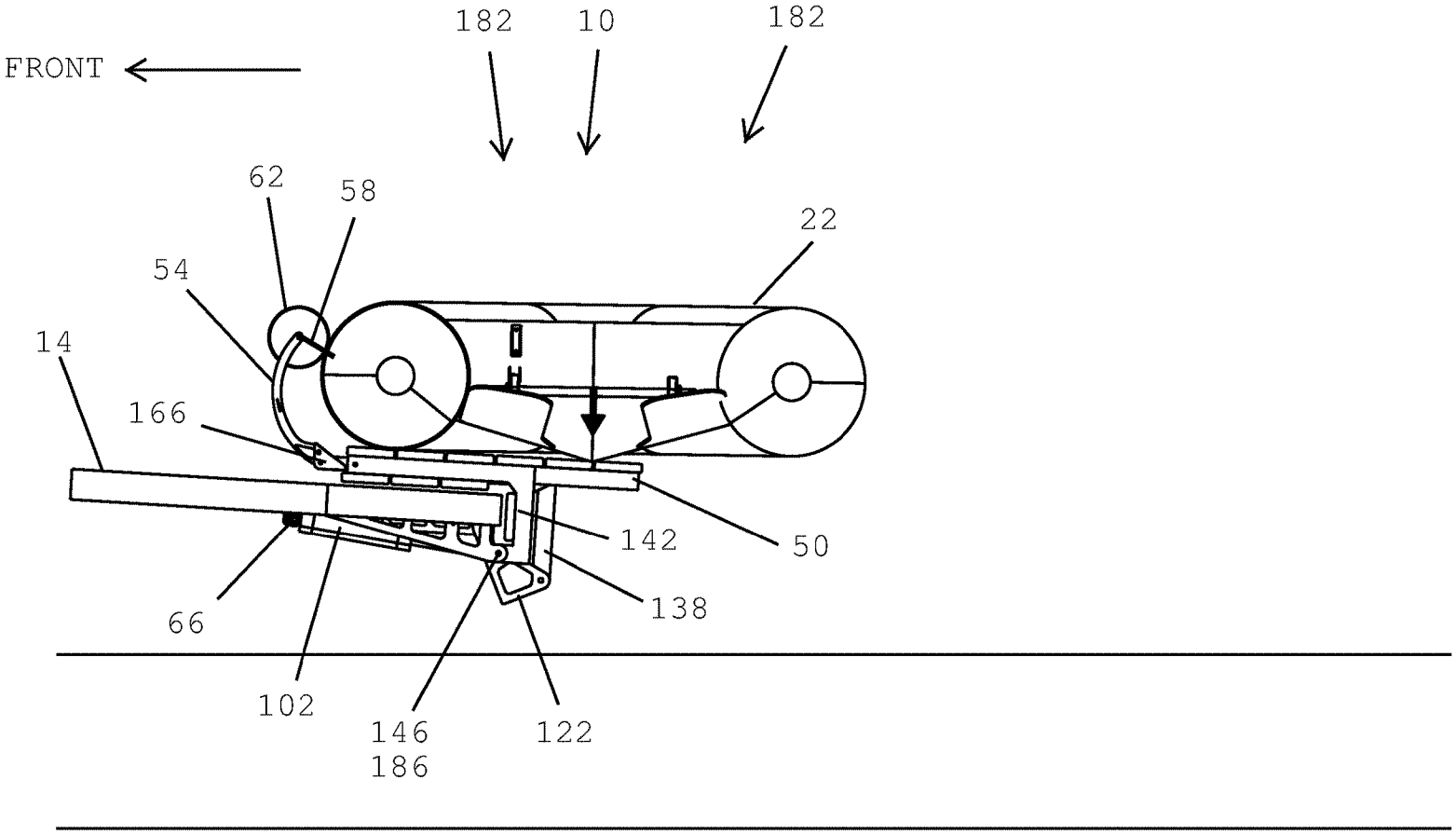
FIG. 11 is a left elevational side view of a watercraft boarding apparatus connected to a boat in a final onboard configuration in accordance with principles and embodiments of the present invention.

FIG. 10 is illustrating a fifth stage 178 with the watercraft 22 contacting the watercraft-supporting side 86 of the pivotable platform 50 on the side proximal to the WBA 10 while the opposite side of de watercraft 22 remains partially supported by the water 26. Now, more weight from the watercraft 22 is beginning to rest on the pivotable platform 50 while a portion of the weight of the watercraft 22 remains in contact and supported by water 26. At this stage an increasing amount of the watercraft's 22 weight is supported by the member pivots 146 and the actuator 102. The actuator 102 is hence supporting only a smaller fraction of the weight of the watercraft 22 because the watercraft 22 is distributing its weight on both sides of the pivot 146 hence balancing each side resting weight on the pivot and limiting the force applied on the actuator 102. The weight of the proximal side of the watercraft 22 is counterbalancing the weight of the distal side of the watercraft 22 thus facilitating the boarding of the watercraft 22. This is allowing the use of a less powerful, smaller and lighter actuator 102 to perform the boarding. Finally, a sixth stage 182 is illustrated in FIG. 11 and FIG. 12. The watercraft 22 is now completely supported by the WBA 10 and is not in contact anymore with water 26.

Stages one to six 150, 162, 170, 174, 178, 182 are showing the interaction between the lifting, the angle and pivotal motion of the watercraft 22 in conjunction with the water 26 support and the contact with the watercraft-supporting side 86 of the platform 50 progressively reducing the amount of weight supported by the water 26 and the weight being progressively transferred to the member pivots 146 and the actuator 102. One can also appreciate the location of the watercraft 22 in respect with the member pivot 146 is progressively cancelling the weight of the watercraft 22 by balancing the weight of the watercraft 22 on both sides of the member pivots axis 186. This geometry is alleviating the effect of the weight of the watercraft 22 on the actuator 102.

Figure 13:
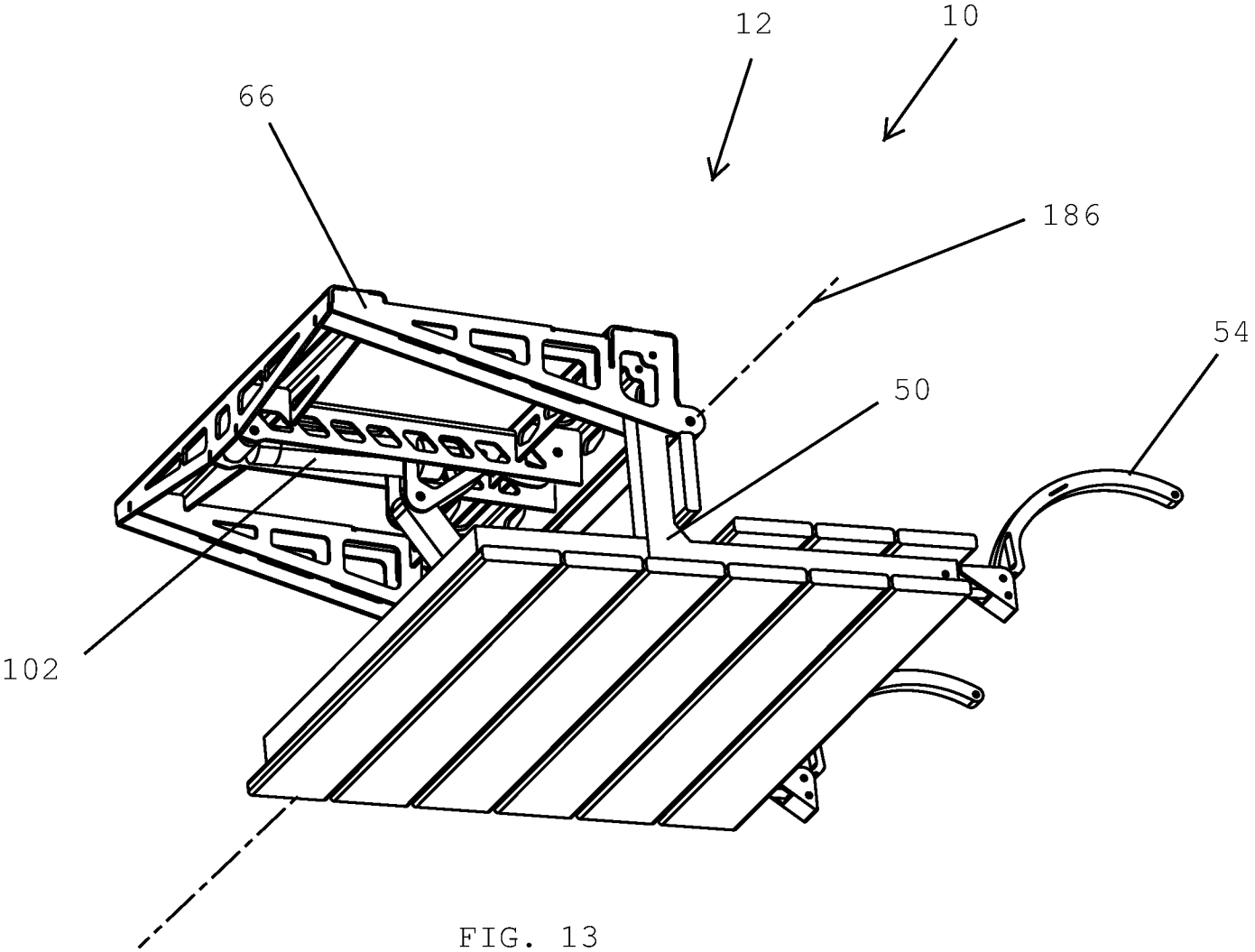
FIG. 13 is a bottom-left perspective side view of a watercraft boarding apparatus in accordance with principles and embodiments of the present invention.
Figure 14:
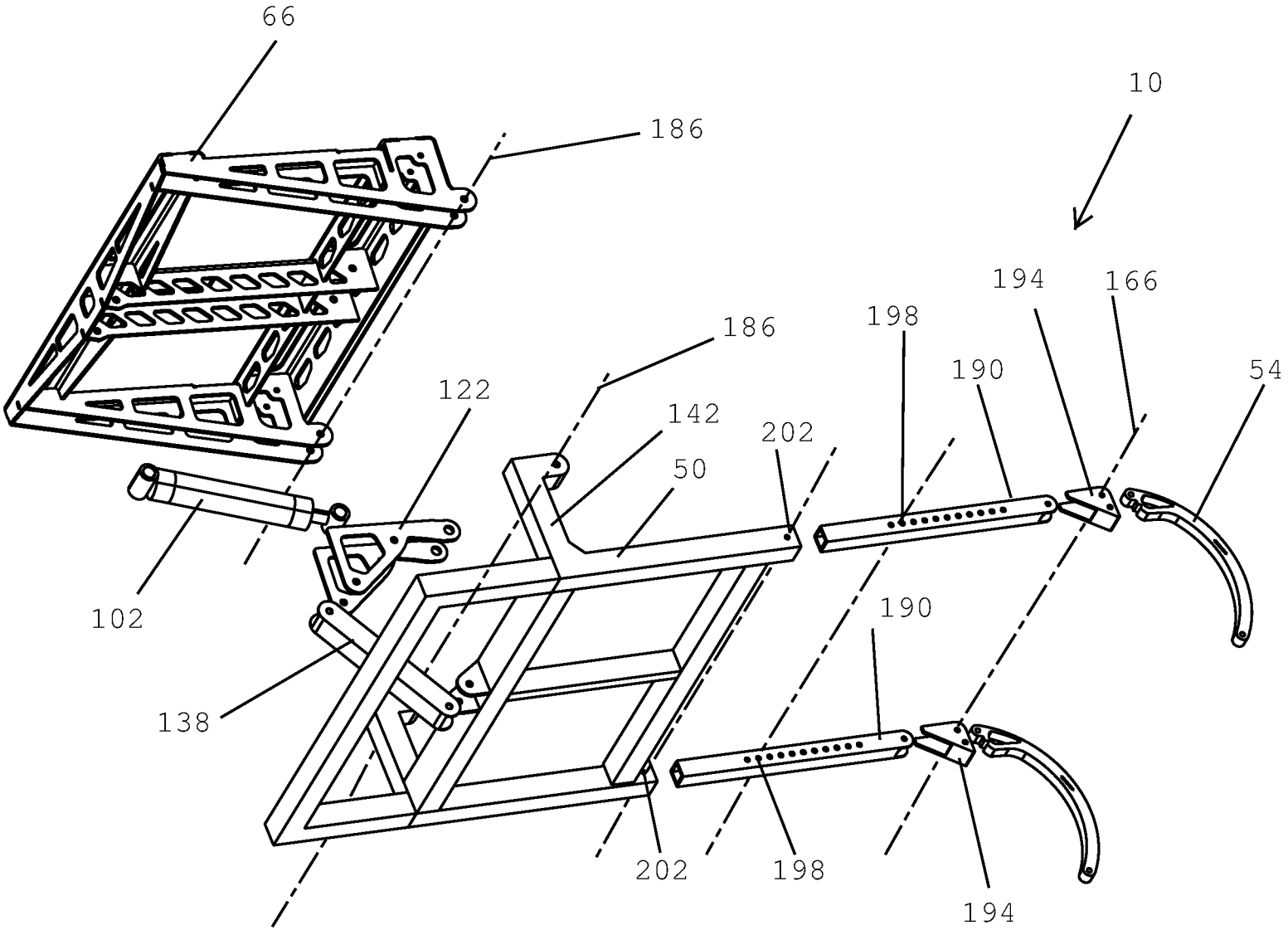
FIG. 14 is a bottom-left perspective side exploded view of a watercraft boarding apparatus connected to a boat in accordance with principles and embodiments of the present invention.
Figure 15:
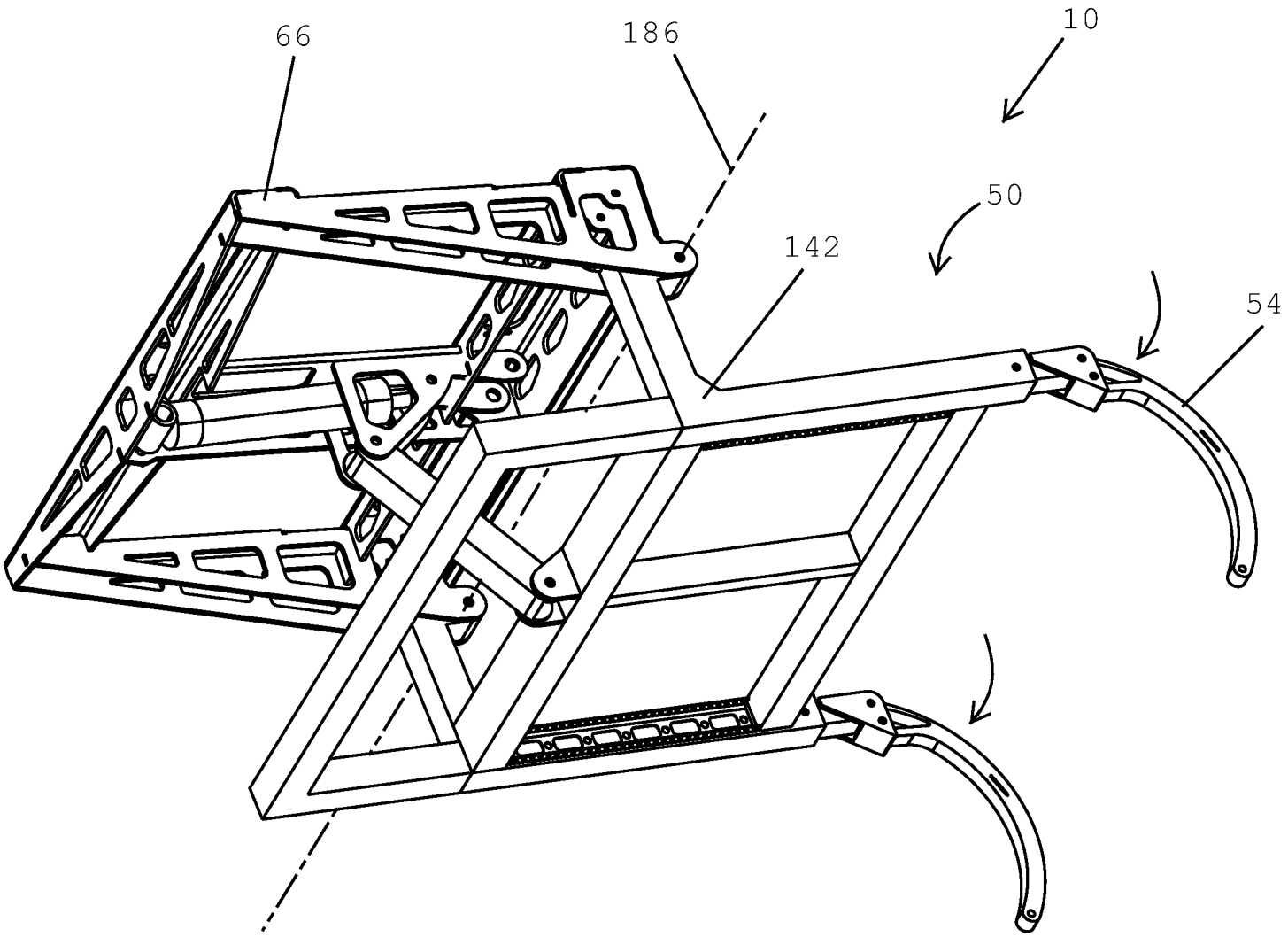
FIG. 15 is a bottom-left perspective side exploded view of a watercraft boarding apparatus in accordance with principles and embodiments of the present invention.
Figure 16:
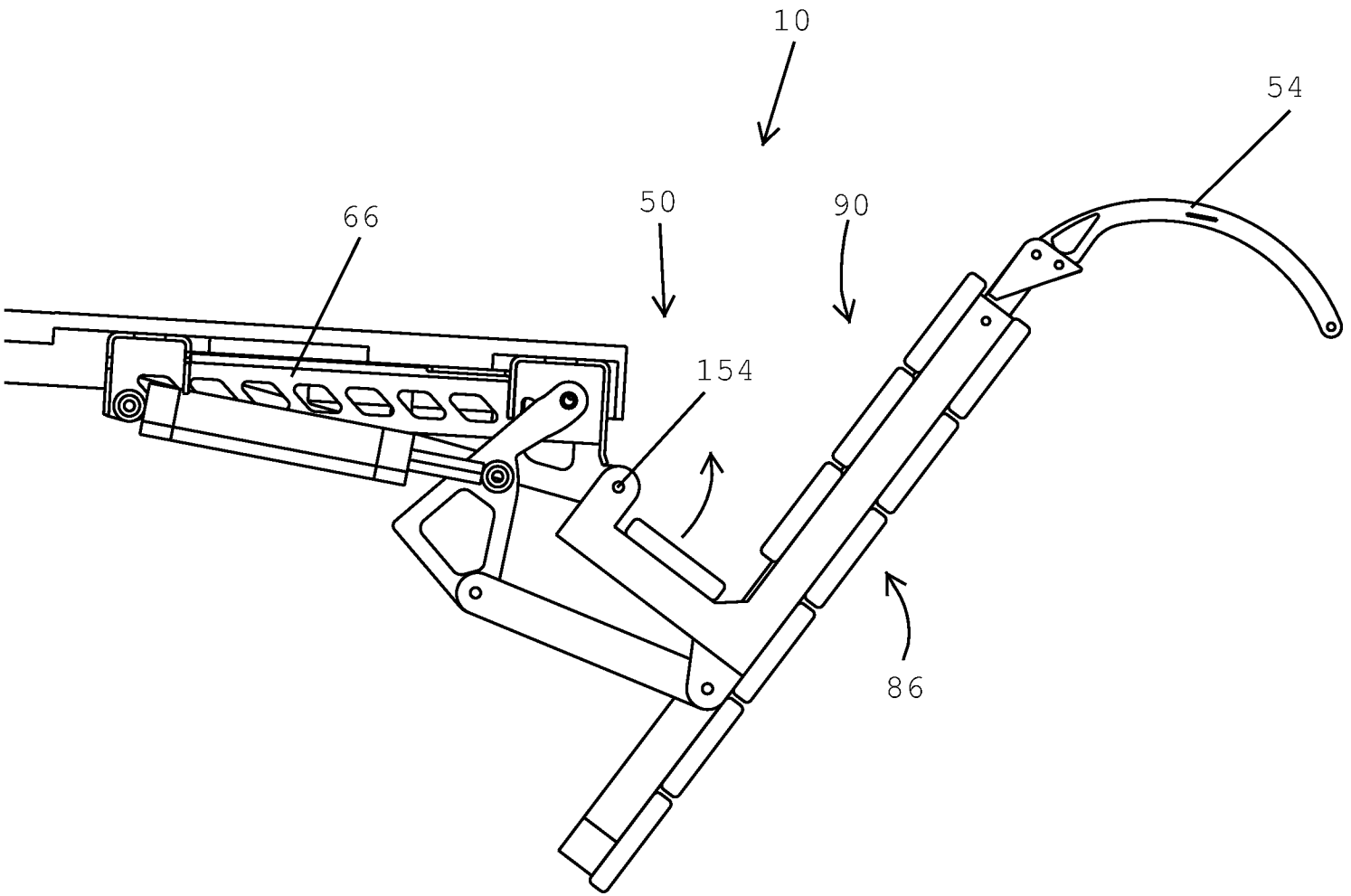
FIG. 16 is a side elevational side view of a watercraft boarding apparatus in accordance with principles and embodiments of the present invention.
Figure 17:
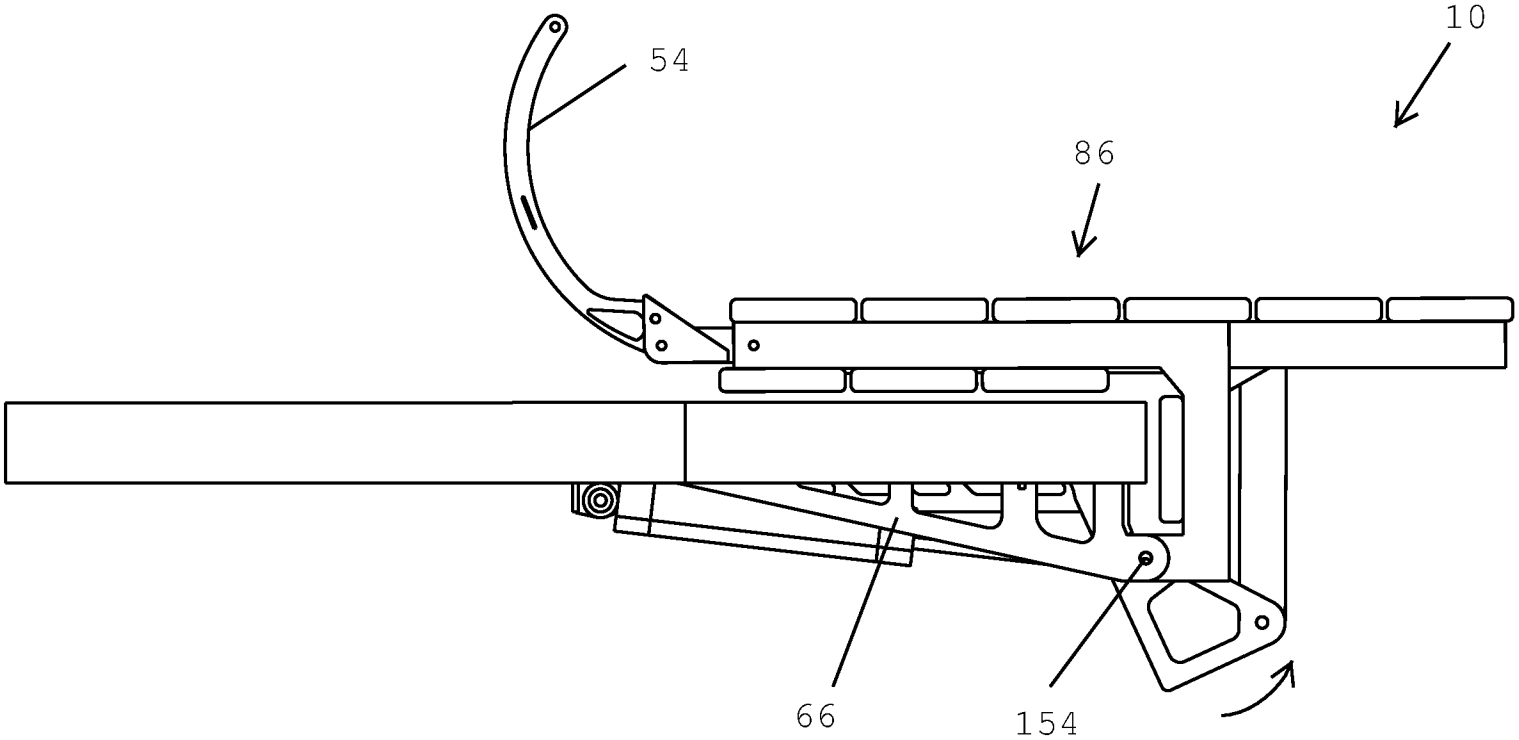
FIG. 17 is a side elevational side view of a watercraft boarding apparatus in accordance with principles and embodiments of the present invention.

FIG. 13 is a perspective view of the WBA 10 in its extended configuration 12 and FIG. 14 illustrates the WBA 10 in an exploded view thereof for increased presentation of the parts constituting the assembly. It is possible to appreciate the components material to construction of the pivot axis 186. Additionally, it is also possible to see the connecting arms 54 are respectively connected to respective extension members 190 via a pivot connector 194. Watercrafts 22 of various sizes and configurations can be boarded with the WBA 10 using the mechanical advantages provided by the embodied structure. With such a consideration, the extension members 190 include a series of adjustment holes 198 configured to receive a locking member therein with engagement of corresponding locking holes 202 located in the pivotable platform 50. This mechanism allows a range of adjustments to position the connecting arm 54 in consideration of the watercraft 22 size and design.

Figure 18:
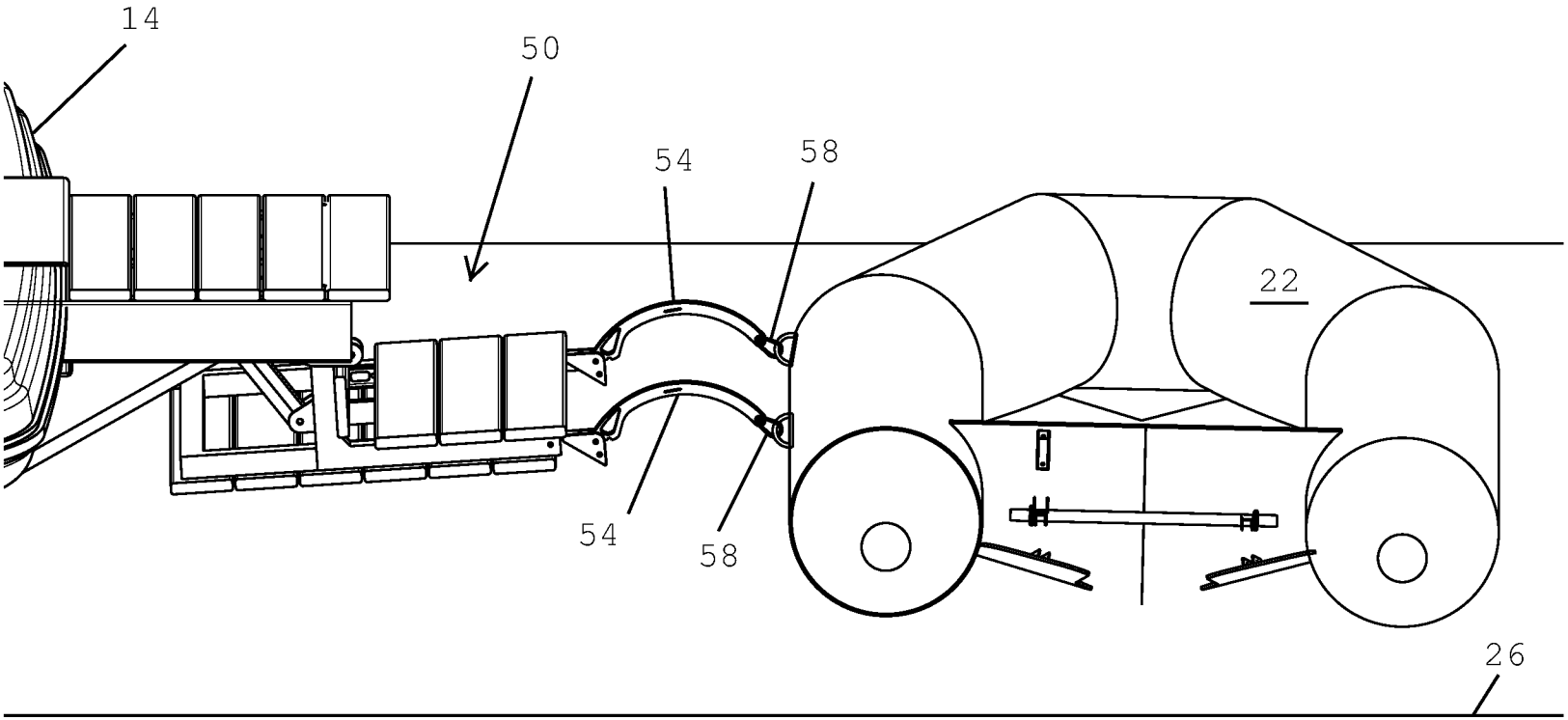
FIG. 18 is a left side elevational side view of a watercraft boarding apparatus connected to a boat in accordance with principles and embodiments of the present invention.
Figure 19:
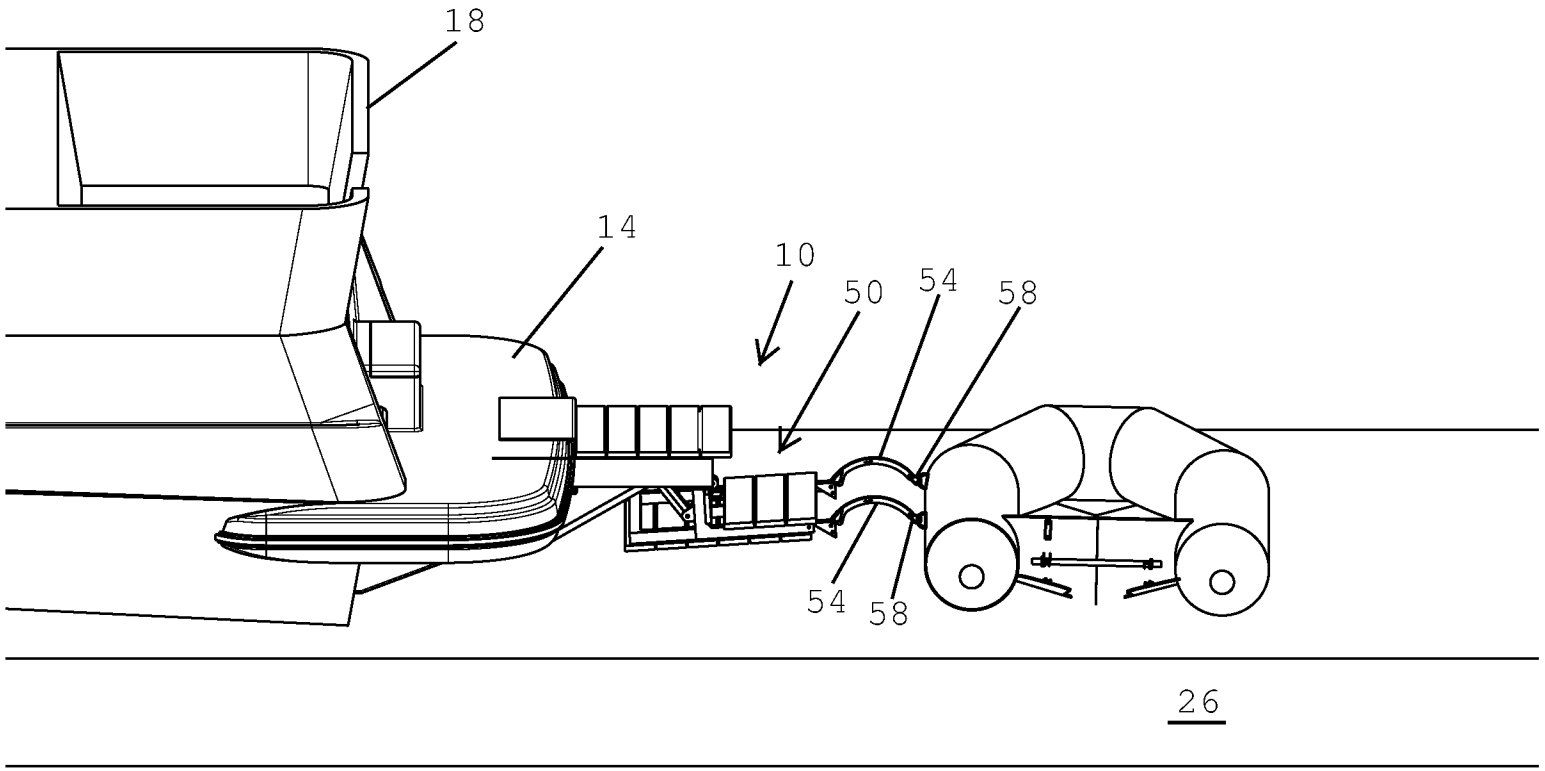
FIG. 19 is a left side elevational side view of a watercraft boarding apparatus connected to a boat in accordance with principles and embodiments of the present invention.
Figure 20:
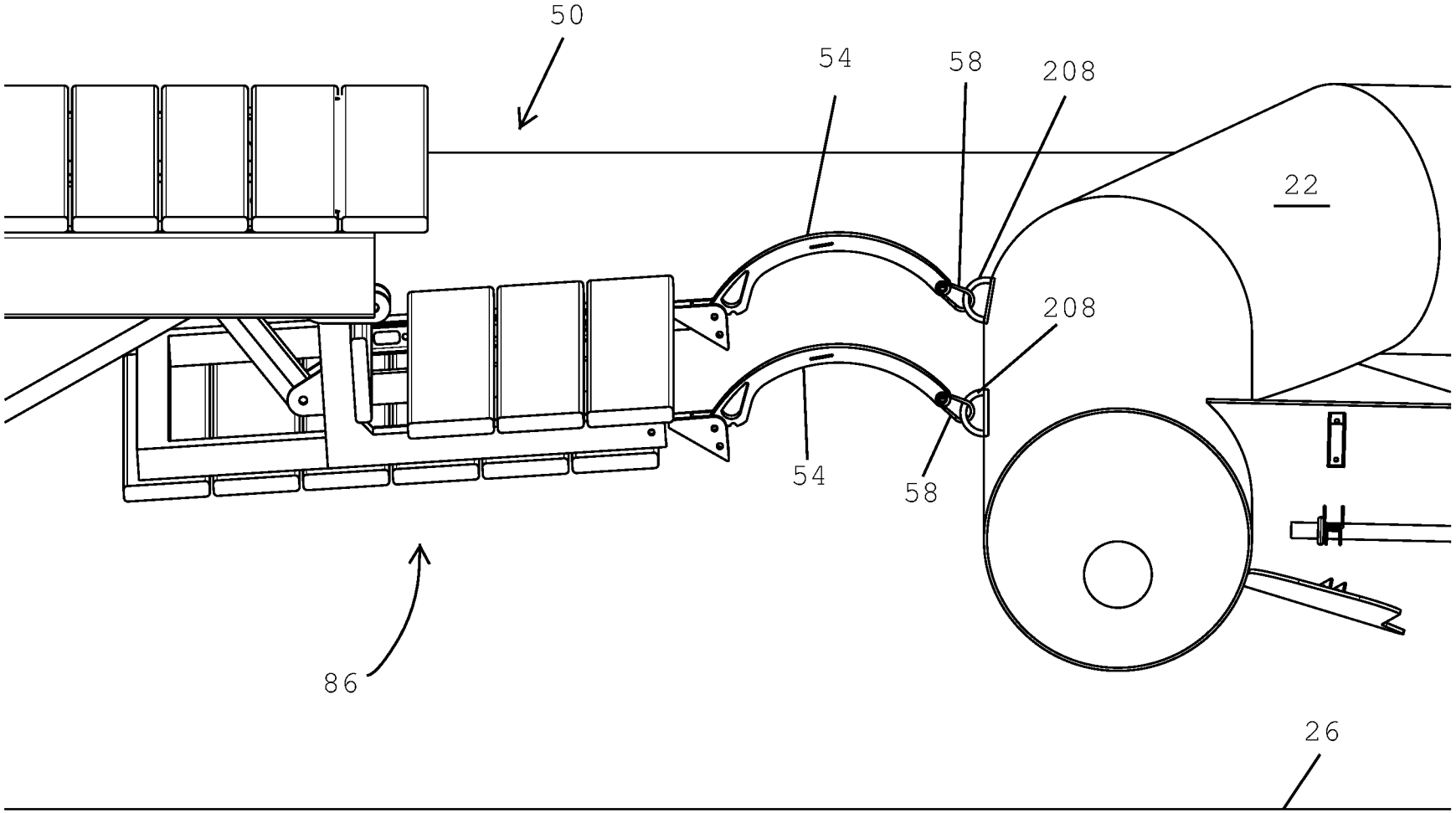
FIG. 20 is a left side elevational side view of a watercraft boarding apparatus in accordance with principles and embodiments of the present invention.

FIG. 18, FIG. 19 and FIG. 20 are illustrating an alternate connection between the WBA 10 and the watercraft 22 using a securing mechanism 58 directly securing connection points 208 from the watercraft 22 without the bumper 62 illustrated in FIG. 7 for a more compact arrangement reducing the lever effect of the mechanism.

Figure 21:
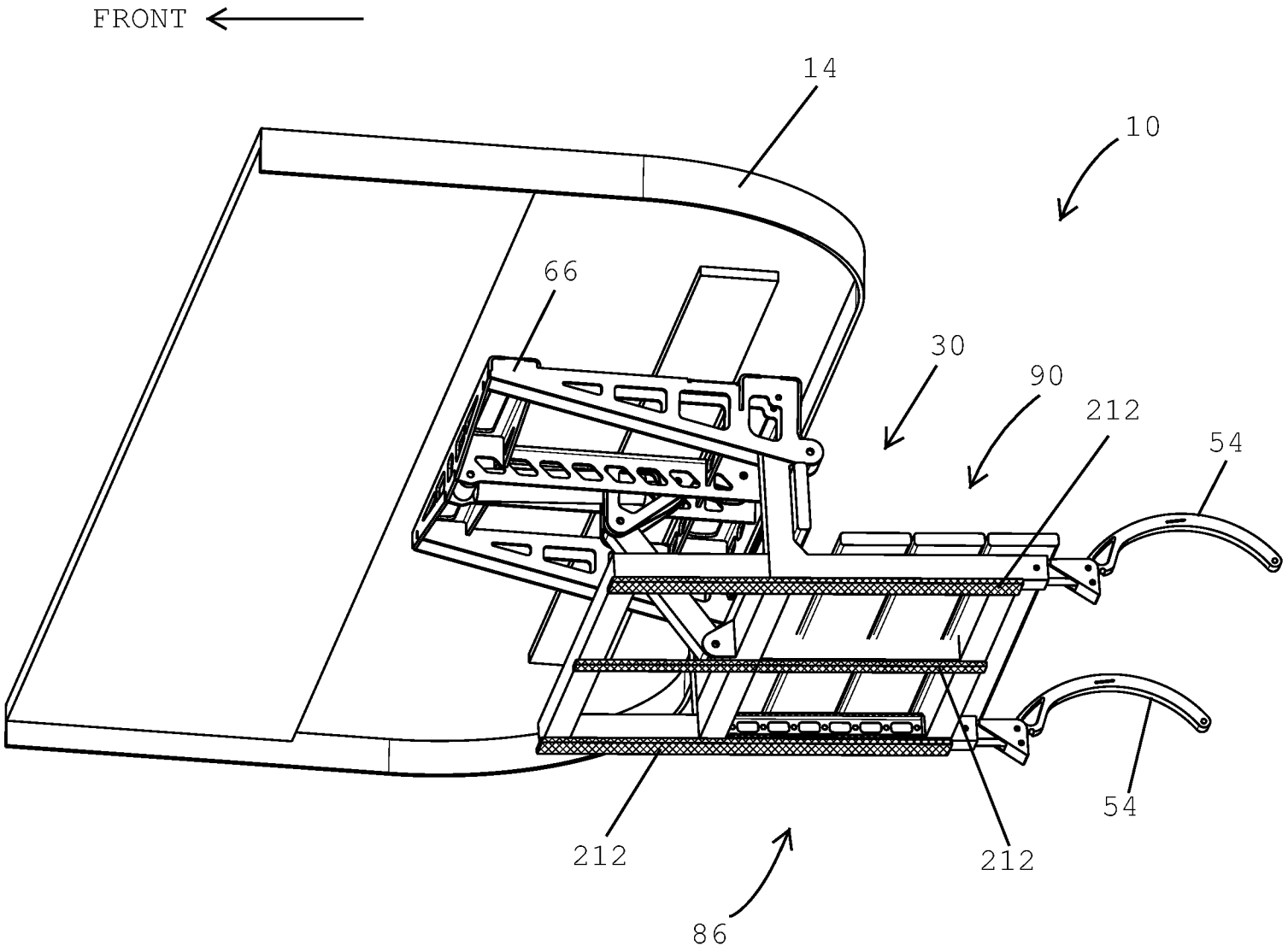
FIG. 21 is a left side elevational side view of a watercraft boarding apparatus connected to a boat in accordance with principles and embodiments of the present invention.

Lastly, FIG. 21 is illustrating an alternate configuration of the pivotable platform 50 using hull-contacting members 212 suitable for contacting the hull of the watercraft 22 without damaging the hull. The hull-contacting members 212 can be embodied as an extruded polymeric material adapted for the size and the weight of the watercraft 22.

While illustrative and presently preferred embodiment(s) of the invention have been described in detail hereinabove, it is to be understood that the inventive concepts may be otherwise variously embodied and employed and that the appended claims are Intended to be construed to include such variations except insofar as limited by the prior Art.

What is claimed is:

1. A watercraft boarding apparatus comprising:

a frame adapted to be secured to an object;

a pivotable platform pivotably secured to the frame about a pivot thereof, the pivotable platform being configured to pivot between an extended configuration for securing a watercraft on water and a boarded configuration supporting the watercraft thereon; and a pair of connecting members secured to the pivotable platform to secure the watercraft, wherein pivotal of the platform is adapted to progressively board the watercraft on the platform by sharing a weight of the watercraft between the pivot and water, and wherein the weight of the watercraft is at least partially counterbalanced on both radial sides of the pivot axis when transitioning between the extended configuration and the boarded configuration.

2. The watercraft boarding apparatus of claim 1, further comprising an actuator connected to the frame to enable pivotal motion of the platform upon actuation.

3. The watercraft boarding apparatus of claim 1, wherein the object is a vessel.

4. The watercraft boarding apparatus of claim 1, wherein the connecting members are connecting arms.

5. The watercraft boarding apparatus of claim 4, wherein the connecting arms include a curve.

6. The watercraft boarding apparatus of claim 1, wherein the pivotable platform includes a watercraft-supporting side and a watercraft-access side.

7. A vessel comprising a watercraft boarding apparatus, the watercraft boarding apparatus comprising:

a frame adapted to be secured to an object;

a pivotable platform pivotably secured to the frame about a pivot thereof, the pivotable platform being adapted to pivot between an extended configuration for securing a watercraft on water and a boarded configuration supporting the watercraft thereon; and a pair of connecting members adapted to secure the pivotable platform to the watercraft, wherein pivotal of the platform is progressively boarding the watercraft on the platform by sharing a weight of the watercraft between the pivot and water, and wherein the weight of the watercraft is at least partially counterbalanced on both radial sides of the pivot axis when transitioning between the extended configuration and the boarded configuration.

8. The vessel of claim 7, further comprising an actuator connected to the frame to enable pivotal motion of the platform upon actuation.

9. The vessel of claim 7, wherein the object is a vessel.

10. The vessel of claim 7, wherein the connecting members are connecting arms.

11. The vessel of claim 10, wherein the connecting arms include a curve.

12. The vessel of claim 7, wherein the pivotable platform includes a watercraft-supporting side and a watercraft-access side.

13. A watercraft boarding apparatus kit comprising:

a frame adapted to be secured to an object;

a pivotable platform pivotably adapted to be secured to the frame about a pivot thereof, the pivotable platform being adapted to pivot between an extended configuration for securing a watercraft on water and a boarded configuration supporting the watercraft thereon; and a pair of connecting members adapted to secure the pivotable platform to the watercraft, wherein pivotal of the platform is progressively boarding the watercraft on the platform by sharing a weight of the watercraft between the pivot and water, and wherein the weight of the watercraft is at least partially counterbalanced on both radial sides of the pivot axis when transitioning between the extended configuration and the boarded configuration.

14. The watercraft boarding apparatus kit of claim 13, further comprising an actuator connected to the frame to enable pivotal motion of the platform upon actuation.

15. The watercraft boarding apparatus kit of claim 13, wherein the object is a vessel.

16. The watercraft boarding apparatus kit of claim 13, wherein the connecting members are connecting arms.

17. The watercraft boarding apparatus kit of claim 13, wherein the pivotable platform includes a watercraft-supporting side and a watercraft-access side.

* * * * *